US005246338A

United States Patent [19]

Takayanagi et al.

[11] Patent Number: 5,246,338

[45] Date of Patent: Sep. 21, 1993

[54] MIXED GAS TURBINE

[75] Inventors: Kiyoshi Takayanagi; Masahide Umaya, both of Takasago, Japan

[73] Assignee: Mitsubishi Jukogyo Kabushiki Kaisha, Tokyo, Japan

[21] Appl. No.: 888,923

[22] Filed: May 27, 1992

[30] Foreign Application Priority Data

May 28, 1991 [JP] Japan ..... 3-38454[U]

[51] Int. Cl.[5] ..... F01D 25/32

[52] U.S. Cl. ..... 415/208.1; 415/93

[58] Field of Search ..... 415/208.1, 211.2, 182.1, 415/108, 93, 101, 102

[56] References Cited

U.S. PATENT DOCUMENTS

| | | | |
|---|---|---|---|
| 875,912 | 1/1908 | Heymann | 415/108 |
| 969,869 | 9/1910 | Hodgkinson | 415/93 |
| 1,128,132 | 2/1915 | Grun | 415/102 |
| 1,391,698 | 9/1921 | Schneider | 415/177 |
| 1,405,090 | 1/1922 | Baumann | 415/102 |
| 1,526,792 | 2/1925 | Kasley | 415/102 |
| 2,394,125 | 2/1946 | Warren | 415/108 |
| 3,700,353 | 10/1972 | Ortolano | 415/102 |
| 3,738,770 | 6/1973 | Bolter | 415/101 |

FOREIGN PATENT DOCUMENTS

| | | | |
|---|---|---|---|
| 314035 | 12/1916 | Fed. Rep. of Germany | 415/102 |
| 336887 | 1/1920 | Fed. Rep. of Germany | 415/102 |
| 367125 | 10/1906 | France | 415/102 |
| 1025463 | 4/1953 | France | 415/102 |
| 93607 | 6/1982 | Japan | 415/208.1 |
| 889507 | 6/1962 | United Kingdom | 415/102 |

*Primary Examiner*—John T. Kwon

*Attorney, Agent, or Firm*—Wenderoth, Lind & Ponack

[57] ABSTRACT

In a mixed gas turbine, wherein excessive steam in a plant is mixed with exhaust gas of a high-pressure turbine and then introduced to a low-pressure turbine, the present invention makes improvements such that even when a flow rate of the main flow in the high-pressure turbine is small, an efficiency may not be lowered. A final stage of a high-pressure turbine and a mixed-gas pressure adjusting stage are arrayed in opposition with an exhaust gas chamber of a high-pressure turbine casing placed therebetween, also a flow passage guide plate is provided within the exhaust gas chamber to rectify the flows of the exhaust gas in the final stage and the mixed-gas in the pressure adjusting stage and lead them to an exhaust gas port and a low-pressure turbine communication pipe by mixing their pressures.

3 Claims, 3 Drawing Sheets

MIXED GAS TURBINE

BACKGROUND OF THE INVENTION

1. Field of the Invention

The present invention relates to a mixed gas turbine, in which a structure of a gas mixing section has been improved.

2. Description of the Prior Art

A mixed gas turbine is also called "mixed pressure turbine", and in the case where medium-pressure or low-pressure steam is excessive in a plant mainly in an industry-owned electric power generating plant of a paper manufactory, an industry-owned electric power generating plant for feeding both heat and electricity in an industrial complex, or the like, the excessive steam is introduced to an intermediate stage of a turbine to be effectively utilized as a power source for a low-pressure turbine. As the type of mixing gases, a type of connecting a gas-mixing pipe 14 provided with a mixed-gas stop valve 15 and a mixed-gas adjusting valve to a communication pipe 13 for connecting a high-pressure turbine casing 1 with a low-pressure turbine casing 11 as shown in a system diagram in FIG. 2, and a type where mixed-gas introduced from a mixed-gas pipe into a mixed-gas inlet B of a high-pressure turbine casing is received in a gas-mixing chamber C provided in a part of the casing 1 and after it has been mixed with exhaust gas from a final stage 3 of a high-pressure turbine, it is introduced to an initial stage 12 of a low-pressure turbine as shown in FIG. 3, are known.

In either one of these known types, in the case where a flow rate of steam flowing through the high-pressure turbine is large as compared to a flow rate of mixed-gas, a pressure loss caused by the mixed-gas adjusting valve is not large, and with respect to an efficiency, it does not become disadvantageous. In addition, even in the type shown in FIG. 3, since a step H between the high-pressure turbine final stage and the low-pressure turbine initial stage does not become so large, the structure would not become complex.

While the shortcomings such that an efficiency is deteriorated nor that a configuration of a turbine becomes complex does not occur in the case where a flow rate of steam flowing through a high-pressure turbine is large as compared to a flow rate of mixed-gas, the shortcomings would become remarkable under the following conditions:

1) When a flow rate in the high-pressure stage forming a main flow is small, a pressure at a mixed-gas joining section is low and a pressure difference from a source pressure on the mixed-gas feed side becomes large, these all result in pressure loss of a mixed-gas adjusting valve, and an efficiency is lowered.

2) In the case where a flow rate of mixed-gas is larger than a flow rate in the high-pressure stage, in relation to a flow passage area of a turbine blade lattice, a step of turbine disc diameters between a final stage of a high-pressure turbine and a first stage of a low-pressure turbine would become large, and so, a structure for compensating the step would become complex.

SUMMARY OF THE INVENTION

It is therefore one object of the present invention to provide an improved mixed-gas turbine of the type that excessive steam in a plant is mixed with exhaust gas of a high-pressure turbine and then introduced to a low-pressure turbine, wherein an efficiency is not lowered even when a flow rate of a main flow in the high-pressure turbine is small.

According to one feature of the present invention, there is provided a mixed-gas turbine, wherein a final stage of a high-pressure turbine and a mixed-gas pressure adjusting stage are arrayed in opposition with an exhaust gas chamber of a high-pressure turbine casing placed therebetween.

According to another feature of the present invention, there is provided the above-featured mixed-gas turbine, wherein a flow passage guide plate is provided within the exhaust gas chamber of the high-pressure turbine casing.

According to still another feature of the present invention, there is provided the above-featured mixed-gas turbine, wherein there is provided a flow passage guide plate formed so as to protrude towards an exhaust gas port connected to the exhaust gas chamber of the high-pressure turbine casing.

According to the present invention, owing to the structural feature that a final stage of a high-pressure turbine and a mixed-gas pressure adjusting stage are arrayed in opposition with an exhaust gas chamber of a high-pressure turbine casing placed therebetween, a flow rate of mixed-gas ejected to the mixed-gas pressure adjusting stage can be adjusted by varying a steam ejection area of a nozzle by means of a mixed-gas adjusting valve, hence pressure loss of a mixed-gas adjusting valve can be made small especially at the time of small flow rate, and with respect to an efficiency, the invention is advantageous.

In addition, according to the present invention, owing to the structural feature that a flow passage guide plate is provided within the exhaust gas chamber of the high-pressure turbine casing and the same flow passage guide plate is formed so as to protrude towards an exhaust gas port connected to the exhaust gas chamber of the high-pressure turbine casing, it is possible to rectify the flows of the exhaust gas in the final stage and the mixed-gas in the pressure adjusting stage and to smoothly lead them to an exhaust gas port and also to a low-pressure turbine via the exhaust gas port by mixing their pressures. Furthermore, even if a step caused by a difference in blade disc diameters between the final stage of the high-pressure turbine and the mixed-gas pressure adjusting stage should exist, absorption of the step can be done in any way by changing the configuration of the flow passage guide plate.

The above-mentioned and other objects, features and advantages of the present invention will become more apparent by reference to the following description of one preferred embodiment of the invention taken in conjunction with the accompanying drawings.

DESCRIPTION OF THE PREFERRED EMBODIMENT

Figure 1:
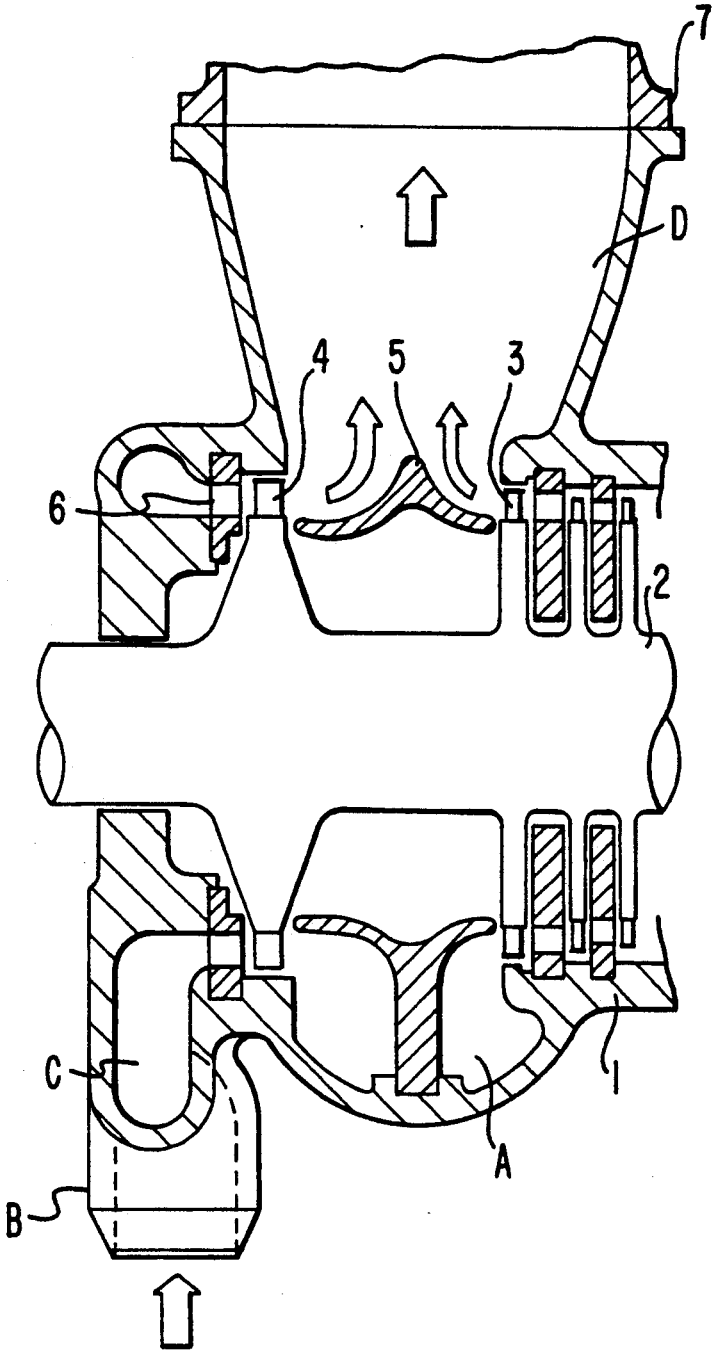
FIG. 1 is a cross-section view showing an exhaust gas chamber and an exhaust gas port section of a high-pressure turbine casing according to one preferred embodiment of the present invention.
Figure 2:
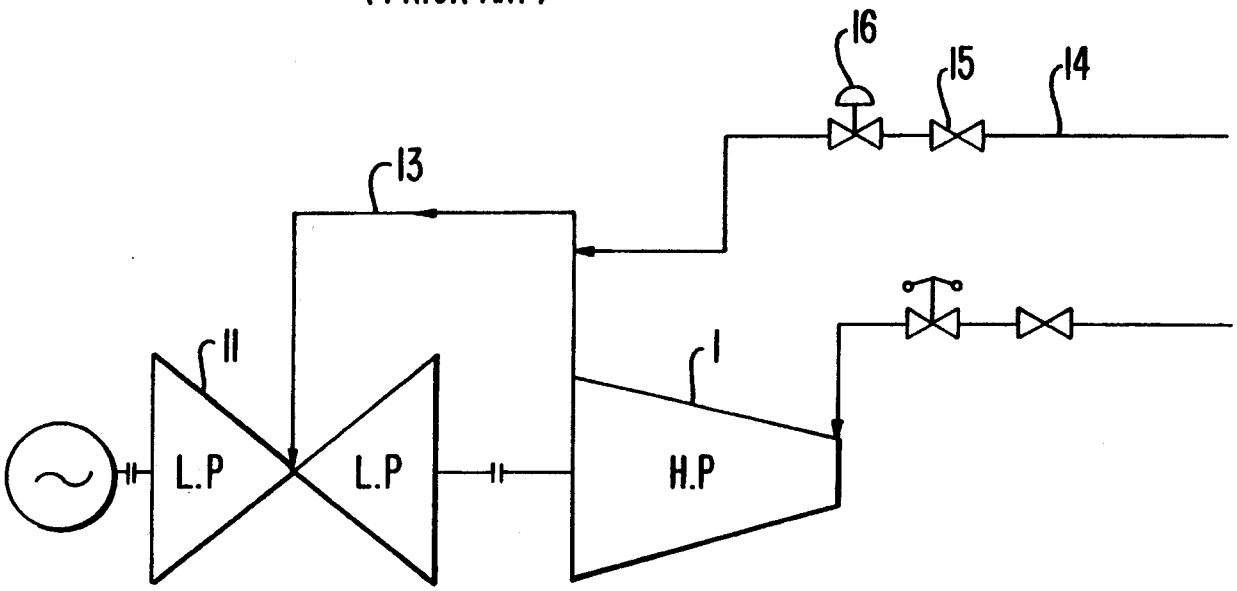
FIG. 2 (PRIOR ART)
FIG. 2 is a system diagram showing one example of a mixed-gas turbine in the prior art.
Figure 3:
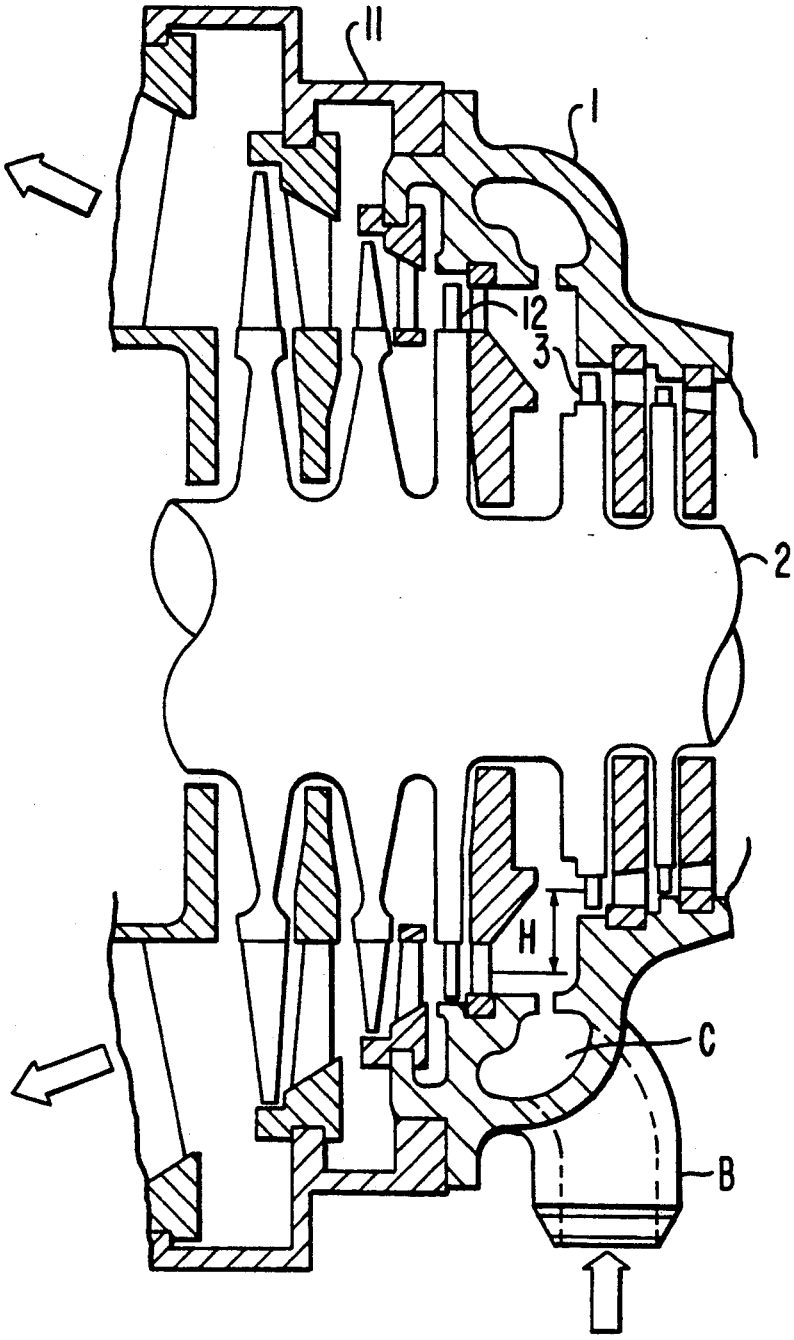
FIG. 3 (PRIOR ART)
FIG. 3 is a cross-section view showing another example of a mixed-gas turbine in the prior art.

Now one preferred embodiment of the present invention will be described with reference to FIG. 1. This figure is a cross-section view of an exhaust gas chamber and an exhaust gas port section of a high-pressure turbine casing. A turbine shaft 2 is accommodated within a turbine casing 1, and on discs of this turbine shaft 2 are arrayed a high-pressure turbine final stage 3 and a mixed-gas pressure adjusting stage 4 in opposition with an exhaust gas chamber A placed therebetween. In the exhaust gas chamber A between the high-pressure turbine final stage 3 and the mixed-gas pressure adjusting stage 4 is mounted a flow passage guide plate 5 in order to rectify the flows of the exhaust gas in the final stage 3 and the mixed gas of the pressure adjusting stage 4, hence the exhaust gas and the mixed-gas are mixed in pressure at this place, and they flow towards a low-pressure turbine as guided by an exhaust gas port D and an exhaust gas communication pipe 7 connected to the exhaust gas chamber A. The above-mentioned flow passage guide plate 5 is formed so as to protrude towards the exhaust gas port D.

Mixed-gas nozzles 6 and mixed-gas chambers C of the mixed-gas pressure adjusting stage 4 are partitioned into 4 blocks along the circumferential direction, and they are respectively kept independent. And provision is made such that the amount of the mixed-gas may be distributed to 4 blocks by means of a mixed-gas adjusting valve (not shown in the figure) disposed upstream of a mixed-gas inlet B. Accordingly, the distributed mixed-gas enters the mixed-gas chamber C through the mixed-gas inlet nozzle B, then it is ejected through the mixed-gas nozzle 6 into the mixed-gas pressure adjusting stage 4, and its flow is rectified by the flow passage guide plate 5 formed so as to protrude towards the exhaust gas port D.

As described above, by providing the mixed-gas pressure adjusting stage 4 and varying an inflow area of the pressure adjusting stage according to a flow rate of the mixed-gas, improvements in efficiency can be achieved even in a turbine having a large mixed-gas flow rate. More particularly, in a turbine having a larger mixed-gas flow rate than a main steam flow rate, if blade lattices is arrayed without making the high-pressure turbine final stage 3 and the mixed-gas pressure adjusting stage 4 oppose to each other, a relatively large step (a difference in the height of blades) would be produced, and smooth flows could not be realized. Furthermore, it is difficult to change the pressure adjusting stage inflow area according to a flow rate of steam, and it is compelled to employ such structure that main flow steam is once led to the outside of the casing and mixed-gas steam is made to flow into that piping. However, in the illustrated embodiment, owing to the fact that the high-pressure turbine final stage 3 and the mixed-gas pressure adjusting stage 4 are arrayed in opposition, a main flow and a mixed-gas flow having largely different flow rates can be made to join smoothly within a turbine, and a turbine structure also becomes compact.

As will be apparent from the detailed description of a preferred embodiment above, according to the present invention the following remarkable effects and advantages can be obtained:

(1) Since the so-called "nozzle cutout system" in which a steam ejection area of a mixed-gas nozzle can be adjusted by means of a mixed-gas adjusting valve, can be employed, even at the time of a small flow rate, adjustment matched to that flow rate can be achieved, hence a pressure loss at the mixed-gas adjusting valve can be made small, and so, in view of an efficiency the invention is advantageous.

(2) Even if a large difference should exist in the diameters of blade lattices between a high-pressure turbine final stage and a mixed-gas pressure adjusting stage, the difference could be easily absorbed by means of the flow passage guide plate, and therefore, the turbine would not become complex in structure.

While a principle of the present invention has been described above in connection to one preferred embodiment of the invention, it is a matter of course that many apparently widely different embodiments of the present invention can be made without departing from the spirit of the invention.

What is claimed is:

1. A mixed-gas turbine comprising: a high-pressure turbine casing defining an exhaust gas chamber; a turbine shaft accommodated in said casing; said turbine shaft constituting a final stage of a high-pressure turbine located to one side of said exhaust chamber, and a mixed-gas pressure adjusting stage located to the other side of said exhaust gas chamber; a plurality of mixed-gas chambers confronting said mixed-gas pressure adjusting stage, said mixed-gas chambers being disposed in the circumferential direction of the mixed-gas pressure adjusting stage and being partitioned from each other; a mixed-gas nozzle placing each of said mixed-gas chambers in communication with said mixed-gas pressure adjusting stage; and a mixed-gas inlet communicating with said mixed-gas chambers, whereby mixed gas can be distributed to respective ones of said mixed-gas chambers to regulate the flow rate of the mixed gas passing through the pressure-adjusting stage and into the exhaust gas chamber.

2. A mixed-gas turbine as claimed in claim 1, and further comprising a guide plate disposed in the exhaust gas chamber of said high-pressure turbine casing.

3. A mixed-gas turbine as claimed in claim 1, and further comprising an exhaust gas port integral with said high-pressure turbine casing and open to said exhaust gas chamber, and a guide plate protruding from said exhaust gas chamber toward said exhaust gas port.

* * * * *